US011203924B2

(12) United States Patent
Oehring et al.

(10) Patent No.: US 11,203,924 B2
(45) Date of Patent: Dec. 21, 2021

(54) AUTOMATED FRACTURING SYSTEM AND METHOD

(71) Applicant: U.S. Well Services, LLC, Houston, TX (US)

(72) Inventors: Jared Oehring, Houston, TX (US); Brandon N. Hinderliter, Houston, TX (US); Alexander James Christinzio, Morgantown, WV (US)

(73) Assignee: U.S. Well Services, LLC, Houston, TX (US)

( * ) Notice: Subject to any disclaimer, the term of this patent is extended or adjusted under 35 U.S.C. 154(b) by 0 days.

(21) Appl. No.: 16/564,185

(22) Filed: Sep. 9, 2019

(65) Prior Publication Data

US 2020/0141219 A1 May 7, 2020

Related U.S. Application Data

(63) Continuation of application No. 16/160,708, filed on Oct. 15, 2018, now Pat. No. 10,408,031.

(Continued)

(51) Int. Cl.

| | |
|---|---|
| ***E21B 43/26*** | (2006.01) |
| ***E21B 21/06*** | (2006.01) |
| ***E21B 41/00*** | (2006.01) |

(52) U.S. Cl.

CPC ..... *E21B 43/26* (2013.01); *E21B 21/062* (2013.01); *E21B 41/0092* (2013.01)

(58) Field of Classification Search

CPC ..... E21B 43/26

See application file for complete search history.

(56) References Cited

U.S. PATENT DOCUMENTS

| | | | |
|---|---|---|---|
| 1,656,861 | A | 1/1928 | Leonard |
| 1,671,436 | A | 5/1928 | Melott |

(Continued)

FOREIGN PATENT DOCUMENTS

| | | |
|---|---|---|
| CA | 2406801 | 11/2001 |
| CA | 2707269 | 12/2010 |

(Continued)

OTHER PUBLICATIONS

Canadian Office Action dated Aug. 17, 2020 in related CA Patent Application No. 2,944,968.

(Continued)

*Primary Examiner* — Kenneth L Thompson

(74) *Attorney, Agent, or Firm* — Hogan Lovells US LLP

(57) ABSTRACT

An automated hydraulic fracturing system, including a pump system, a blender configured to form the fracturing fluid, a proppant storage and delivery system, a hydration unit configured to mix an additive into a fluid to form the fluid mixture and provide the fluid mixture to the blender, a fluid storage and delivery system, and an additive storage and delivery system, and an automated control system including a plurality of sensing devices and a plurality of control devices integrated into the pump system, the blender system, the proppant storage and delivery system, the fluid storage and delivery system, and the additive storage and delivery system, the automated control system configured to monitor parameters of the automated hydraulic fracturing system via the plurality of sensing devices and transmit control instructions for one or more of the plurality of control devices to control an aspect of the automated hydraulic fracturing system.

20 Claims, 6 Drawing Sheets

Related U.S. Application Data

(60) Provisional application No. 62/572,148, filed on Oct. 13, 2017.

(56) References Cited

U.S. PATENT DOCUMENTS 2,004,077 A 6/1935 McCartney
2,183,364 A 12/1939 Bailey
2,220,622 A 11/1940 Aitken
2,248,051 A 7/1941 Armstrong
2,407,796 A 9/1946 Page
2,416,848 A 3/1947 Rothery
2,610,741 A 9/1952 Schmid
2,753,940 A 7/1956 Bonner
3,055,682 A 9/1962 Bacher
3,061,039 A 10/1962 Peters
3,066,503 A 12/1962 Fleming
3,302,069 A 1/1967 Webster
3,334,495 A 8/1967 Jensen
3,722,595 A 3/1973 Kiel
3,764,233 A 10/1973 Strickland
3,773,140 A 11/1973 Mahajan
3,837,179 A 9/1974 Barth
3,849,662 A 11/1974 Blaskowski
3,878,884 A 4/1975 Raleigh
3,881,551 A 5/1975 Terry
4,037,431 A 7/1977 Sugimoto
4,100,822 A 7/1978 Rosman
4,151,575 A 4/1979 Hogue
4,226,299 A 10/1980 Hansen
4,265,266 A 5/1981 Kierbow et al.
4,432,064 A 2/1984 Barker
4,442,665 A 4/1984 Fick et al.
4,456,092 A 6/1984 Kubozuka
4,506,982 A 3/1985 Smithers et al.
4,512,387 A 4/1985 Rodriguez
4,529,887 A 7/1985 Johnson
4,538,916 A 9/1985 Zimmerman
4,676,063 A 6/1987 Goebel et al.
4,759,674 A 7/1988 Schroder
4,793,386 A 12/1988 Sloan
4,845,981 A 7/1989 Pearson
4,922,463 A 5/1990 Del Zotto et al.
5,004,400 A 4/1991 Handke
5,006,044 A 4/1991 Walker, Sr.
5,025,861 A 6/1991 Huber
5,050,673 A 9/1991 Baldridge
5,114,239 A 5/1992 Allen
5,130,628 A 7/1992 Owen
5,131,472 A 7/1992 Dees et al.
5,172,009 A 12/1992 Mohan
5,189,388 A 2/1993 Mosley
5,230,366 A 7/1993 Marandi
5,334,899 A 8/1994 Skybyk
5,366,324 A 11/1994 Arlt
5,422,550 A 6/1995 McClanahan
5,433,243 A 7/1995 Griswold
5,439,066 A 8/1995 Gipson
5,517,822 A 5/1996 Haws et al.
5,548,093 A 8/1996 Sato
5,590,976 A 1/1997 Kilheffer et al.
5,655,361 A 8/1997 Kishi
5,736,838 A 4/1998 Dove et al.
5,755,096 A 5/1998 Holleyman
5,790,972 A 8/1998 Kohlenberger
5,798,596 A 8/1998 Lordo
5,865,247 A 2/1999 Paterson
5,879,137 A 3/1999 Fie
5,894,888 A 4/1999 Wiemers
5,907,970 A 6/1999 Havlovick et al.
5,950,726 A 9/1999 Roberts
6,035,265 A 3/2000 Dister et al.
6,097,310 A 8/2000 Harrell et al.
6,121,705 A 9/2000 Hoong
6,138,764 A 10/2000 Scarsdale et al.
6,142,878 A 11/2000 Barin
6,164,910 A 12/2000 Mayleben
6,202,702 B1 3/2001 Ohira
6,208,098 B1 3/2001 Kume
6,254,462 B1 7/2001 Kelton
6,271,637 B1 8/2001 Kushion
6,273,193 B1 8/2001 Hermann
6,315,523 B1 11/2001 Mills
6,477,852 B2 11/2002 Dodo
6,484,490 B1 11/2002 Olsen
6,491,098 B1 12/2002 Dallas
6,529,135 B1 3/2003 Bowers et al.
6,626,646 B2 9/2003 Rajewski
6,719,900 B2 4/2004 Hawkins
6,765,304 B2 7/2004 Baten et al.
6,776,227 B2 8/2004 Beida
6,788,022 B2 9/2004 Sopko
6,802,690 B2 10/2004 Han
6,808,303 B2 10/2004 Fisher
6,931,310 B2 8/2005 Shimizu et al.
6,936,947 B1 8/2005 Leijon
6,985,750 B1 * 1/2006 Vicknair ..... H04W 8/20 370/310
7,082,993 B2 8/2006 Ayoub
7,104,233 B2 9/2006 Ryczek et al.
7,170,262 B2 1/2007 Pettigrew
7,173,399 B2 2/2007 Sihler
7,308,933 B1 12/2007 Mayfield
7,312,593 B1 12/2007 Streicher et al.
7,336,514 B2 2/2008 Amarillas
7,445,041 B2 11/2008 O'Brien
7,494,263 B2 2/2009 Dykstra et al.
7,500,642 B2 3/2009 Cunningham
7,525,264 B2 4/2009 Dodge
7,563,076 B2 7/2009 Brunet
7,581,379 B2 9/2009 Yoshida
7,675,189 B2 3/2010 Grenier
7,683,499 B2 3/2010 Saucier
7,717,193 B2 5/2010 Egilsson et al.
7,755,310 B2 7/2010 West et al.
7,795,830 B2 9/2010 Johnson
7,807,048 B2 10/2010 Collette
7,835,140 B2 11/2010 Mori
7,845,413 B2 12/2010 Shampine et al.
7,926,562 B2 4/2011 Poitzsch
7,894,757 B2 7/2011 Keast
7,977,824 B2 7/2011 Halen et al.
7,984,757 B1 7/2011 Keast
8,037,936 B2 10/2011 Neuroth
8,054,084 B2 11/2011 Schulz et al.
8,083,504 B2 12/2011 Williams
8,091,928 B2 1/2012 Carrier
8,096,354 B2 1/2012 Poitzsch
8,096,891 B2 1/2012 Lochtefeld
8,139,383 B2 3/2012 Efraimsson
8,146,665 B2 4/2012 Neal
8,154,419 B2 4/2012 Daussin et al.
8,232,892 B2 7/2012 Overholt et al.
8,261,528 B2 9/2012 Chillar
8,272,439 B2 9/2012 Strickland
8,310,272 B2 11/2012 Quarto
8,354,817 B2 1/2013 Yeh et al.
8,474,521 B2 7/2013 Kajaria
8,506,267 B2 8/2013 Gambier et al.
8,534,235 B2 9/2013 Chandler
8,573,303 B2 11/2013 Kerfoot
8,596,056 B2 12/2013 Woodmansee
8,616,005 B1 12/2013 Cousino
8,616,274 B2 12/2013 Belcher et al.
8,646,521 B2 2/2014 Bowen
8,692,408 B2 4/2014 Zhang et al.
8,727,068 B2 5/2014 Bruin
8,760,657 B2 6/2014 Pope
8,763,387 B2 7/2014 Schmidt
8,774,972 B2 7/2014 Rusnak
8,789,601 B2 7/2014 Broussard
8,795,525 B2 8/2014 McGinnis et al.
8,800,652 B2 8/2014 Bartko
8,807,960 B2 8/2014 Stephenson
8,838,341 B2 9/2014 Kumano

(56) References Cited

U.S. PATENT DOCUMENTS 8,851,860 B1 10/2014 Mail
8,857,506 B2 10/2014 Stone, Jr.
8,899,940 B2 12/2014 Laugemors
8,905,056 B2 12/2014 Kendrick
8,905,138 B2 12/2014 Lundstedt et al.
8,997,904 B2 4/2015 Cryer
9,018,881 B2 4/2015 Mao et al.
9,051,822 B2 6/2015 Ayan
9,051,923 B2 6/2015 Kuo
9,061,223 B2 6/2015 Winborn
9,062,545 B2 6/2015 Roberts et al.
9,067,182 B2 6/2015 Nichols
9,103,193 B2 8/2015 Coli
9,119,326 B2 8/2015 McDonnell
9,121,257 B2 9/2015 Coli et al.
9,140,110 B2 9/2015 Coli et al.
9,160,168 B2 10/2015 Chapel
9,260,253 B2 2/2016 Naizer
9,322,239 B2 4/2016 Boza et al.
9,324,049 B2 4/2016 Thomeer
9,340,353 B2 5/2016 Oren
9,366,114 B2 6/2016 Coli et al.
9,410,410 B2 8/2016 Broussard et al.
9,450,385 B2 9/2016 Kristensen
9,475,020 B2 10/2016 Coli et al.
9,475,021 B2 10/2016 Coli et al.
9,482,086 B2 11/2016 Richardson et al.
9,499,335 B2 11/2016 McIver
9,506,333 B2 11/2016 Castillo et al.
9,513,055 B1 12/2016 Seal
9,534,473 B2 1/2017 Morris et al.
9,562,420 B2 2/2017 Morris et al.
9,587,649 B2 3/2017 Oehring
9,611,728 B2 4/2017 Oehring
9,650,871 B2 5/2017 Oehring et al.
9,650,879 B2 5/2017 Broussard et al.
9,706,185 B2 7/2017 Ellis
9,728,354 B2 8/2017 Skolozdra
9,738,461 B2 8/2017 DeGaray
9,739,546 B2 8/2017 Bertilsson et al.
9,745,840 B2 8/2017 Oehring et al.
9,840,901 B2 12/2017 Oehring et al.
9,863,228 B2 1/2018 Shampine et al.
9,893,500 B2 2/2018 Oehring
9,909,398 B2 3/2018 Pham
9,915,128 B2 3/2018 Hunter
9,932,799 B2 4/2018 Symchuk
9,963,961 B2 5/2018 Hardin
9,970,278 B2 5/2018 Broussard
9,976,351 B2 5/2018 Randall
9,995,218 B2 6/2018 Oehring
10,008,880 B2 6/2018 Vicknair
10,020,711 B2 7/2018 Oehring
10,036,238 B2 7/2018 Oehring
10,107,086 B2 10/2018 Oehring
10,119,381 B2 11/2018 Oehring
10,184,465 B2 1/2019 Enis et al.
10,196,878 B2 2/2019 Hunter
10,221,639 B2 3/2019 Romer et al.
10,227,854 B2 3/2019 Glass
10,232,332 B2 3/2019 Oehring
10,246,984 B2 4/2019 Payne
10,254,732 B2 4/2019 Oehring
10,260,327 B2 4/2019 Kajaria
10,280,724 B2 5/2019 Hinderliter
10,287,873 B2 5/2019 Filas
10,302,079 B2 5/2019 Kendrick
10,309,205 B2 6/2019 Randall
10,337,308 B2 7/2019 Broussard
10,371,012 B2 8/2019 Davis
10,378,326 B2 8/2019 Morris
10,393,108 B2 8/2019 Chong
10,407,990 B2 9/2019 Oehring
10,408,030 B2 9/2019 Oehring et al.
10,408,031 B2 * 9/2019 Oehring ..... E21B 21/062
10,415,332 B2 9/2019 Morris et al.
10,436,026 B2 10/2019 Ounadjela
10,627,003 B2 4/2020 Dale et al.
10,648,311 B2 5/2020 Oehring et al.
10,669,471 B2 6/2020 Schmidt et al.
10,669,804 B2 6/2020 Kotrla
10,695,950 B2 6/2020 Igo et al.
10,711,576 B2 7/2020 Bishop
10,740,730 B2 * 8/2020 Altamirano ..... G06Q 10/06316
10,794,165 B2 10/2020 Fischer et al.
2001/0000996 A1 5/2001 Grimland et al.
2002/0169523 A1 11/2002 Ross et al.
2003/0079875 A1 1/2003 Weng
2003/0056514 A1 3/2003 Lohn
2003/0138327 A1 7/2003 Jones et al.
2004/0040746 A1 3/2004 Niedermayr et al.
2004/0102109 A1 5/2004 Cratty et al.
2004/0167738 A1 8/2004 Miller
2005/0061548 A1 3/2005 Hooper
2005/0116541 A1 6/2005 Seiver
2005/0201197 A1 9/2005 Duell et al.
2005/0274508 A1 12/2005 Folk
2006/0052903 A1 3/2006 Bassett
2006/0065319 A1 3/2006 Csitari
2006/0109141 A1 5/2006 Huang
2007/0131410 A1 6/2007 Hill
2007/0187163 A1 8/2007 Cone
2007/0201305 A1 8/2007 Heilman et al.
2007/0226089 A1 9/2007 DeGaray et al.
2007/0277982 A1 12/2007 Shampine
2007/0278140 A1 12/2007 Mallet et al.
2008/0017369 A1 1/2008 Sarada
2008/0041596 A1 2/2008 Blount
2008/0095644 A1 4/2008 Mantei et al.
2008/0112802 A1 5/2008 Orlando
2008/0137266 A1 6/2008 Jensen
2008/0164023 A1 7/2008 Dykstra et al.
2008/0208478 A1 8/2008 Ella et al.
2008/0217024 A1 9/2008 Moore
2008/0257449 A1 10/2008 Weinstein et al.
2008/0264625 A1 10/2008 Ochoa
2008/0264649 A1 10/2008 Crawford
2008/0277120 A1 11/2008 Hickie
2009/0045782 A1 2/2009 Datta
2009/0065299 A1 3/2009 Vito
2009/0072645 A1 3/2009 Quere
2009/0078410 A1 3/2009 Krenek et al.
2009/0093317 A1 4/2009 Kajiwara et al.
2009/0095482 A1 4/2009 Surjaatmadja
2009/0145611 A1 6/2009 Pallini, Jr.
2009/0153354 A1 6/2009 Daussin et al.
2009/0188181 A1 7/2009 Forbis
2009/0200035 A1 8/2009 Bjerkreim et al.
2009/0260826 A1 10/2009 Sherwood
2009/0308602 A1 12/2009 Bruins et al.
2010/0000508 A1 1/2010 Chandler
2010/0019574 A1 1/2010 Baldassarre et al.
2010/0038907 A1 2/2010 Hunt
2010/0045109 A1 2/2010 Arnold
2010/0051272 A1 3/2010 Loree et al.
2010/0132949 A1 6/2010 DeFosse et al.
2010/0146981 A1 6/2010 Motakef
2010/0172202 A1 7/2010 Borgstadt
2010/0250139 A1 9/2010 Hobbs et al.
2010/0293973 A1 11/2010 Erickson
2010/0303655 A1 12/2010 Scekic
2010/0322802 A1 12/2010 Kugelev
2011/0005757 A1 1/2011 Hebert
2011/0017468 A1 1/2011 Birch et al.
2011/0052423 A1 3/2011 Gambier et al.
2011/0061855 A1 3/2011 Case et al.
2011/0081268 A1 4/2011 Ochoa et al.
2011/0085924 A1 4/2011 Shampine
2011/0110793 A1 5/2011 Leugemores et al.
2011/0166046 A1 7/2011 Weaver
2011/0247878 A1 10/2011 Rasheed
2011/0272158 A1 11/2011 Neal
2012/0018016 A1 1/2012 Gibson
2012/0049625 A1 3/2012 Hopwood

(56) References Cited

U.S. PATENT DOCUMENTS

2012/0063936 A1 3/2012 Baxter et al.
2012/0085541 A1 4/2012 Love et al.
2012/0127635 A1 5/2012 Grindeland
2012/0150455 A1 6/2012 Franklin et al.
2012/0152716 A1 6/2012 Kikukawa et al.
2012/0205301 A1 8/2012 McGuire et al.
2012/0205400 A1 8/2012 DeGaray et al.
2012/0222865 A1 9/2012 Larson
2012/0232728 A1 9/2012 Karimi et al.
2012/0247783 A1 10/2012 Berner, Jr.
2012/0255734 A1 10/2012 Coli et al.
2013/0009469 A1 1/2013 Gillett
2013/0025706 A1 1/2013 DeGaray et al.
2013/0175038 A1 7/2013 Conrad
2013/0175039 A1 7/2013 Guidry
2013/0180722 A1 7/2013 Olarte Caro et al.
2013/0189629 A1 7/2013 Chandler
2013/0199617 A1 8/2013 DeGaray et al.
2013/0233542 A1 9/2013 Shampine
2013/0255271 A1 10/2013 Yu et al.
2013/0284278 A1 10/2013 Winborn
2013/0284455 A1 10/2013 Kajaria et al.
2013/0299167 A1 11/2013 Fordyce et al.
2013/0306322 A1 11/2013 Sanborn
2013/0317750 A1 11/2013 Hunter
2013/0341029 A1 12/2013 Roberts et al.
2013/0343858 A1 12/2013 Flusche
2014/0000899 A1 1/2014 Nevison
2014/0010671 A1 1/2014 Cryer et al.
2014/0054965 A1 2/2014 Jain
2014/0060658 A1 3/2014 Hains
2014/0095114 A1 4/2014 Thomeer
2014/0096974 A1 4/2014 Coli
2014/0124162 A1 5/2014 Leavitt
2014/0138079 A1 5/2014 Broussard
2014/0174717 A1 6/2014 Broussard et al.
2014/0219824 A1 8/2014 Burnette
2014/0238683 A1 8/2014 Korach
2014/0246211 A1 9/2014 Guidry et al.
2014/0251623 A1 9/2014 Lestz et al.
2014/0255214 A1 9/2014 Burnette
2014/0277772 A1 9/2014 Lopez
2014/0290768 A1 10/2014 Randle
2014/0379300 A1 12/2014 Devine
2015/0027712 A1 1/2015 Vicknair
2015/0053426 A1 2/2015 Smith
2015/0068724 A1 3/2015 Coli et al.
2015/0068754 A1 3/2015 Coli et al.
2015/0075778 A1 3/2015 Walters
2015/0083426 A1 3/2015 Lesko
2015/0097504 A1 4/2015 Lamascus
2015/0114652 A1 4/2015 Lestz
2015/0136043 A1 5/2015 Shaaban
2015/0144336 A1 5/2015 Hardin et al.
2015/0147194 A1 5/2015 Foote
2015/0159911 A1 6/2015 Holt
2015/0175013 A1 6/2015 Cryer et al.
2015/0176386 A1 6/2015 Castillo et al.
2015/0211512 A1 7/2015 Wiegman
2015/0211524 A1 7/2015 Broussard
2015/0217672 A1 8/2015 Shampine
2015/0225113 A1 8/2015 Lungu
2015/0233530 A1 8/2015 Sandidge
2015/0252661 A1 9/2015 Glass
2015/0300145 A1 10/2015 Coli et al.
2015/0300336 A1 10/2015 Hernandez
2015/0314225 A1 11/2015 Coli et al.
2015/0330172 A1 11/2015 Allmaras
2015/0354322 A1 12/2015 Vicknair
2016/0006311 A1 1/2016 Li
2016/0032703 A1 2/2016 Broussard et al.
2016/0102537 A1 4/2016 Lopez
2016/0105022 A1 4/2016 Oehring
2016/0208592 A1 4/2016 Oehring
2016/0160889 A1 6/2016 Hoffman et al.
2016/0177675 A1 6/2016 Morris et al.
2016/0177678 A1 6/2016 Morris
2016/0186531 A1 6/2016 Harkless et al.
2016/0208593 A1 7/2016 Coli et al.
2016/0208594 A1 7/2016 Coli et al.
2016/0208595 A1 7/2016 Tang
2016/0221220 A1 8/2016 Paige
2016/0230524 A1 8/2016 Dumoit
2016/0230525 A1 8/2016 Lestz et al.
2016/0258267 A1 9/2016 Payne et al.
2016/0265457 A1 9/2016 Stephenson
2016/0273328 A1 9/2016 Oehring
2016/0273456 A1 9/2016 Zhang et al.
2016/0281484 A1 9/2016 Lestz
2016/0290114 A1 10/2016 Oehring
2016/0290563 A1 10/2016 Diggins
2016/0312108 A1 10/2016 Lestz et al.
2016/0319650 A1 11/2016 Oehring
2016/0326853 A1 11/2016 Fred et al.
2016/0326854 A1 11/2016 Broussard
2016/0326855 A1 11/2016 Coli et al.
2016/0341281 A1 11/2016 Brunvold et al.
2016/0348479 A1 12/2016 Oehring
2016/0349728 A1 12/2016 Oehring
2016/0369609 A1 12/2016 Morris et al.
2017/0016433 A1 1/2017 Chong
2017/0021318 A1 1/2017 McIver et al.
2017/0022788 A1 1/2017 Oehring et al.
2017/0022807 A1 1/2017 Dursun
2017/0028368 A1 2/2017 Oehring et al.
2017/0030177 A1 2/2017 Oehring et al.
2017/0030178 A1 2/2017 Oehring et al.
2017/0036178 A1 2/2017 Goli et al.
2017/0036872 A1 2/2017 Wallace
2017/0037717 A1 2/2017 Oehring
2017/0037718 A1 2/2017 Coli et al.
2017/0043280 A1 2/2017 Vankouwenberg
2017/0051732 A1 2/2017 Hemandez et al.
2017/0074076 A1 3/2017 Joseph et al.
2017/0082033 A1 3/2017 Wu et al.
2017/0096885 A1 4/2017 Oehring
2017/0096889 A1 4/2017 Blanckaert et al.
2017/0104389 A1 4/2017 Morris et al.
2017/0114625 A1 4/2017 Norris
2017/0130743 A1 5/2017 Anderson
2017/0138171 A1 5/2017 Richards et al.
2017/0145918 A1 5/2017 Oehring
2017/0146189 A1 5/2017 Herman
2017/0159570 A1 6/2017 Bickert
2017/0159654 A1 6/2017 Kendrick
2017/0175516 A1 6/2017 Eslinger
2017/0204852 A1 7/2017 Barnett
2017/0212535 A1* 7/2017 Shelman ..... E21B 34/02
2017/0218727 A1 8/2017 Oehring
2017/0218843 A1 8/2017 Oehring
2017/0222409 A1 8/2017 Oehring
2017/0226838 A1 8/2017 Ceizobka et al.
2017/0226839 A1 8/2017 Broussard
2017/0226842 A1 8/2017 Omont et al.
2017/0234250 A1 8/2017 Janik
2017/0241221 A1 8/2017 Seshadri
2017/0259227 A1 9/2017 Morris et al.
2017/0292513 A1 10/2017 Haddad
2017/0313499 A1 11/2017 Hughes et al.
2017/0314380 A1 11/2017 Oehring
2017/0314979 A1 11/2017 Ye
2017/0328179 A1 11/2017 Dykstra
2017/0369258 A1 12/2017 DeGaray
2017/0370639 A1 12/2017 Barden et al.
2018/0028992 A1 2/2018 Stegemoeller
2018/0038216 A1 2/2018 Zhang
2018/0045331 A1 2/2018 Lopez
2018/0090914 A1 3/2018 Johnson et al.
2018/0156210 A1 6/2018 Oehring
2018/0181830 A1* 6/2018 Luharuka ..... E21B 41/0021
2018/0183219 A1 6/2018 Oehring
2018/0216455 A1 8/2018 Andreychuk
2018/0238147 A1 8/2018 Shahri
2018/0245428 A1 8/2018 Richards

(56) References Cited

U.S. PATENT DOCUMENTS

| | | | |
|---|---|---|---|
| 2018/0258746 | A1 | 9/2018 | Broussard |
| 2018/0259080 | A1 | 9/2018 | Dale et al. |
| 2018/0266217 | A1 | 9/2018 | Funkhauser et al. |
| 2018/0266412 | A1 | 9/2018 | Stokkevag |
| 2018/0274446 | A1 | 9/2018 | Oehring |
| 2018/0284817 | A1 | 10/2018 | Cook et al. |
| 2018/0291713 | A1 | 10/2018 | Jeanson |
| 2018/0298731 | A1 | 10/2018 | Bishop |
| 2018/0312738 | A1 | 11/2018 | Rutsch et al. |
| 2018/0313677 | A1 | 11/2018 | Warren et al. |
| 2018/0320483 | A1 | 11/2018 | Zhang |
| 2018/0343125 | A1 | 11/2018 | Clish |
| 2018/0363437 | A1 | 12/2018 | Coli |
| 2018/0363640 | A1 | 12/2018 | Kajita et al. |
| 2019/0003329 | A1 | 1/2019 | Morris |
| 2019/0010793 | A1 | 1/2019 | Hinderliter |
| 2019/0040727 | A1 | 2/2019 | Oehring et al. |
| 2019/0063309 | A1 | 2/2019 | Davis |
| 2019/0100989 | A1 | 4/2019 | Stewart |
| 2019/0112910 | A1 | 4/2019 | Gehring |
| 2019/0119096 | A1 | 4/2019 | Haile |
| 2019/0120024 | A1 | 4/2019 | Oehring |
| 2019/0128080 | A1 | 5/2019 | Ross |
| 2019/0128104 | A1 | 5/2019 | Graham et al. |
| 2019/0145251 | A1 | 5/2019 | Johnson |
| 2019/0154020 | A1 | 5/2019 | Glass |
| 2019/0162061 | A1 | 5/2019 | Stepheson |
| 2019/0169971 | A1 | 6/2019 | Oehring |
| 2019/0178057 | A1 | 6/2019 | Hunter |
| 2019/0178235 | A1 | 6/2019 | Coskrey |
| 2019/0203567 | A1 | 7/2019 | Ross |
| 2019/0203572 | A1 | 7/2019 | Morris |
| 2019/0211661 | A1 | 7/2019 | Reckels |
| 2019/0226317 | A1 | 7/2019 | Payne |
| 2019/0245348 | A1 | 8/2019 | Hinderliter |
| 2019/0249527 | A1 | 8/2019 | Kraynek |
| 2019/0257462 | A1 | 8/2019 | Rogers |
| 2019/0292866 | A1 | 9/2019 | Ross |
| 2019/0292891 | A1 | 9/2019 | Kajaria |
| 2019/0316447 | A1 | 10/2019 | Oehring |
| 2020/0047141 | A1 | 2/2020 | Oehring et al. |
| 2020/0088152 | A1 | 3/2020 | Allion et al. |
| 2020/0232454 | A1 | 7/2020 | Chretien |

FOREIGN PATENT DOCUMENTS

| | | | |
|---|---|---|---|
| CA | 2482943 | | 5/2011 |
| CA | 3050131 | | 11/2011 |
| CA | 2955706 | | 10/2012 |
| CA | 2966672 | | 10/2012 |
| CA | 3000322 | | 4/2013 |
| CA | 2787814 | | 2/2014 |
| CA | 2833711 | | 5/2014 |
| CA | 2978706 | | 9/2016 |
| CA | 2944980 | | 2/2017 |
| CA | 3006422 | | 6/2017 |
| CA | 3018485 | | 8/2017 |
| CA | 2964593 | | 10/2017 |
| CA | 2849825 | | 7/2018 |
| CA | 3067854 | A1 | 1/2019 |
| CA | 2919649 | | 2/2019 |
| CA | 2919666 | | 7/2019 |
| CA | 2797081 | | 9/2019 |
| CA | 2945579 | | 10/2019 |
| CN | 101977016 | | 2/2011 |
| CN | 104117308 | A | 10/2014 |
| CN | 104196613 | A | 12/2014 |
| CN | 205986303 | U | 2/2017 |
| CN | 108049999 | A | 5/2018 |
| CN | 112196508 | A | 1/2021 |
| JP | 2004264589 | | 9/2004 |
| WO | 2016/144939 | | 9/2016 |
| WO | 2016/160458 | | 10/2016 |
| WO | 2018044307 | A1 | 3/2018 |
| WO | 2018213925 | A1 | 11/2018 |

OTHER PUBLICATIONS

International Search Report and Written Opinion dated Jun. 23, 2020 in corresponding PCT Application No. PCT/US20/23912.
International Search Report and Written Opinion dated Jul. 22, 2020 in corresponding PCT Application No. PCT/US20/00017.
Office Action dated Aug. 4, 2020 in related U.S. Appl. No. 16/385,070.
Office Action dated Jun. 29, 2020 in related U.S. Appl. No. 16/404,283.
Office Action dated Jun. 29, 2020 in related U.S. Appl. No. 16/728,359.
Office Action dated Jun. 22, 2020 in related U.S. Appl. No. 16/377,861.
Canadian Office Action dated Aug. 18, 2020 in related CA Patent Application No. 2,933,444.
UK Power Networks—Transformers to Supply Heat to Tate Modern—from Press Releases May 16, 2013.
Non-Final Office Action issued in corresponding U.S. Appl. No. 15/293,681 dated Feb. 16, 2017.
Non-Final Office Action issued in corresponding U.S. Appl. No. 15/294,349 dated Mar. 14, 2017.
Final Office Action issued in corresponding U.S. Appl. No. 15/145,491 dated Jan. 20, 2017.
Non-Final Office Action issued in corresponding U.S. Appl. No. 15/145,443 dated Feb. 7, 2017.
Notice of Allowance issued in corresponding U.S. Appl. No. 15/217,040 dated Mar. 28, 2017.
Notice of Allowance issued in corresponding U.S. Appl. No. 14/622,532 dated Mar. 27, 2017.
Non-Final Office Action issued in corresponding U.S. Appl. No. 15/291,842 dated Jan. 6, 2017.
Final Office Action issued in corresponding U.S. Appl. No. 14/622,532 dated Dec. 7, 2016.
Non-Final Office Action issued in corresponding U.S. Appl. No. 14/622,532 dated May 17, 2016.
Final Office Action issued in corresponding U.S. Appl. No. 14/622,532 dated Dec. 21, 2015.
Non-Final Office Action issued in corresponding U.S. Appl. No. 14/622,532 dated Aug. 5, 2015.
Non-Final Office Action issued in corresponding U.S. Appl. No. 15/145,491 dated Sep. 12, 2016.
Non-Final Office Action issued in corresponding U.S. Appl. No. 15/217,040 dated Nov. 29, 2016.
Non-Final Office Action issued in corresponding U.S. Appl. No. 15/235,788 dated Dec. 14, 2016.
Non-Final Office Action issued in corresponding U.S. Appl. No. 15/145,491 dated May 15, 2017.
Non-Final Office Action issued in corresponding U.S. Appl. No. 15/486,970 dated Jun. 22, 2017.
Non-Final Office Action issued in corresponding U.S. Appl. No. 15/487,656 dated Jun. 23, 2017.
Non-Final Office Action issued in corresponding U.S. Appl. No. 15/487,694 dated Jun. 26, 2017.
Final Office Action issued in corresponding U.S. Appl. No. 15/294,349 dated Jul. 6, 2017.
Non-Final Office Action issued in corresponding U.S. Appl. No. 14/884,363 dated Sep. 5, 2017.
Final Office Action issued in corresponding U.S. Appl. No. 15/145,491 dated Sep. 6, 2017.
Non-Final Office Action issued in corresponding U.S. Appl. No. 14/881,535 dated Oct. 6, 2017.
Non-Final Office Action issued in corresponding U.S. Appl. No. 15/145,414 dated Nov. 29, 2017.
Non-Final Office Action issued in corresponding U.S. Appl. No. 15/644,487 dated Nov. 13, 2017.
Canadian Office Action dated Mar. 2, 2018 in related Canadian Patent Application No. 2,833,711.
Office Action dated Apr. 10, 2018 in related U.S. Appl. No. 15/294,349.
Office Action dated Apr. 2, 2018 in related U.S. Appl. No. 15/183,387.
Office Action dated May 29, 2018 in related U.S. Appl. No. 15/235,716.

(56) References Cited

OTHER PUBLICATIONS

Candian Office Action dated Apr. 18, 2018 in related Canadian Patent Application No. 2,928,711.
Canadian Office Action dated Jun. 22, 2018 in related Canadian Patent Application No. 2,886,697.
Office Action dated Jul. 25, 2018 in related U.S. Appl. No. 15/644,487.
Office Action dated Oct. 4, 2018 in related U.S. Appl. No. 15/217,081.
International Search Report and Written Opinion dated Sep. 19, 2018 in related PCT Patent Application No. PCT/US2018/040683.
Canadian Office Action dated Sep. 28, 2018 in related Canadian Patent Application No. 2,945,281.
Office Action dated Dec. 12, 2018 in related U.S. Appl. No. 16/160,708.
International Search Report and Written Opinion dated Jan. 2, 2019 in related PCT Patent Application No. PCT/US18/54542.
International Search Report and Written Opinion dated Jan. 2, 2019 in related PCT Patent Application No. PCT/US18/54548.
International Search Report and Written Opinion dated Dec. 31, 2018 in related PCT Patent Application No. PCT/US18/55913.
International Search Report and Written Opinion dated Jan. 4, 2019 in related PCT Patent Application No. PCT/US18/57539.
Non-Final Office Action dated Feb. 12, 2019 in related U.S. Appl. No. 16/170,695.
International Search Report and Written Opinion dated Feb. 15, 2019 in related PCT Patent Application No. PCT/US18/63977.
International Search Report and Written Opinion dated Mar. 5, 2019 in related PCT Patent Application No. PCT/US18/63970.
Non-Final Office Action dated Feb. 25, 2019 in related U.S. Appl. No. 16/210,749.
Non-Final Office Action dated Mar. 6, 2019 in related U.S. Appl. No. 15/183,387.
Office Action dated Jan. 30, 2019 in related Canadian Patent Application No. 2,936,997.
Office Action dated Mar. 1, 2019 in related Canadian Patent Application No. 2,943,275.
International Search Report and Written Opinion dated Apr. 10, 2019 in corresponding PCT Application No. PCT/US2019/016635.
Notice of Allowance dated Apr. 23, 2019 in corresponding U.S. Appl. No. 15/635,028.
International Search Report and Written Opinion dated Jul. 9, 2019 in corresponding PCT Application No. PCT/US2019/027584.
Non-Final Office Action issued in corresponding U.S. Appl. No. 16/170,695 dated Jun. 7, 2019.
Non-Final Office Action issued in corresponding U.S. Appl. No. 16/268,030 dated May 10, 2019.
Final Office Action issued in corresponding U.S. Appl. No. 16/210,749 dated Jun. 11, 2019.
Canadian Office Action dated May 30, 2019 in corresponding CA Application No. 2,833,711.
Canadian Office Action dated Jun. 20, 2019 in corresponding CA Application No. 2,964,597.
International Search Report and Written Opinion dated Jul. 9, 2019 in related PCT Application No. PCT/US2019/027584.
Office Action dated Jun. 7, 2019 in related U.S. Appl. No. 16/268,030.
International Search Report and Written Opinion dated Sep. 11, 2019 in related PCT Application No. PCT/US2019/037493.
Office Action dated Aug. 19, 2019 in related U.S. Appl. No. 15/356,436.
Office Action dated Oct. 2, 2019 in related U.S. Appl. No. 16/152,732.
Office Action dated Sep. 11, 2019 in related U.S. Appl. No. 16/268,030.
Office Action dated Oct. 11, 2019 in related U.S. Appl. No. 16/385,070.
Office Action dated Sep. 3, 2019 in related U.S. Appl. No. 15/994,772.
Office Action dated Sep. 20, 2019 in related U.S. Appl. No. 16/443,273.
Canadian Office Action dated Oct. 1, 2019 in related Canadian Patent Application No. 2,936,997.
International Search Report and Written Opinion dated Nov. 26, 2019 in related PCT Application No. PCT/US19/51018.
Office Action dated Dec. 6, 2019 in related U.S. Appl. No. 16/564,186.
Non-Final Office dated Oct. 26, 2020 in U.S. Appl. No. 15/356,436.
Non-Final Office dated Oct. 5, 2020 in U.S. Appl. No. 16/443,273.
Non-Final Office Action dated Sep. 29, 2020 in U.S. Appl. No. 16/943,727.
Non-Final Office Action dated Sep. 2, 2020 in U.S. Appl. No. 16/356,263.
Non-Final Office Action dated Aug. 31, 2020 in U.S. Appl. No. 16/167,083.
Albone, "Mobile Compressor Stations for Natural Gas Transmission Service," ASME 67-GT-33, Turbo Expo, Power for Land, Sea and Air, vol. 79887, p. 1-10, 1967.
Canadian Office Action dated Sep. 22, 2020 in Canadian Application No. 2,982,974.
International Search Report and Written Opinion dated Sep. 3, 2020 in PCT/US2020/36932.
"Process Burner" (https://www.cebasrt.com/productsloii-gaslprocess-bumer) Sep. 6, 2018 (Sep. 6, 2018), entire document, especially para (Burners for refinery Heaters].
Water and Glycol Heating Systems# (https://www.heat-inc.com/wg-series-water-glycol-systems/) Jun. 18, 2018 (Jun. 18, 2018), entire document, especially WG Series Water Glycol Systems.
"Heat Exchanger" (https://en.wiklpedia.org/w/index.php?title=Heat_exchanger&oldid=89300146) Dec. 18, 2019 Apr. 2019 (Apr. 18, 2019), entire document, especially para (0001].
Canadian Office Action dated Sep. 8, 2020 in Canadian Patent Application No. 2,928,707.
Canadian Office Action dated Aug. 31, 2020 in Canadian Patent Application No. 2,944,980.
International Search Report and Written Opinion dated Aug. 28, 2020 in PCT/US20/23821.
Non-Final Office Action issued in U.S. Appl. No. 14/881,535 dated May 20, 2020.
Non-Final Office Action issued in U.S. Appl. No. 15/145,443 dated May 8, 2020.
Non-Final Office Action issued in U.S. Appl. No. 16/458,696 dated May 22, 2020.
International Search Report and Written Opinion issued in PCT/US2020/023809 dated Jun. 2, 2020.
Karin, "Duel Fuel Diesel Engines," (2015), Taylor & Francis, pp. 62-63, Retrieved from https://app.knovel.com/hotlink/toc/id:kpDFDE0001/dual-fueal-diesel-engines/duel-fuel-diesel-engines (Year 2015).
Goodwin, "High-voltage auxilliary switchgear for power stations," Power Engineering Journal, 1989, 10 pg. (Year 1989).
International Search Report and Written Opinion dated Jan. 2, 2020 in related PCT Application No. PCT/US19/55325.
Notice of Allowance dated Jan. 9, 2020 in related U.S. Appl. No. 16/570,331.
Non-Final Office Action dated Dec. 23, 2019 in related U.S. Appl. No. 16/597,008.
Non-Final Office Action dated Jan. 10, 2020 in related U.S. Appl. No. 16/597,014.
Non-Final Office Action dated Dec. 6, 2019 in related U.S. Appl. No. 16/564,186.
International Search Report and Written Opinion dated Feb. 11, 2020 in related PCT Application No. PCT/US2019/055323.
Final Office Action dated Mar. 31, 2020 in related U.S. Appl. No. 15/356,436.
Non-Final Office Action dated Mar. 3, 2020 in related U.S. Appl. No. 16/152,695.
International Search Report and Written Opinion mailed in PCT/US20/67526 dated May 6, 2021.
International Search Report and Written Opinion mailed in PCT/US20/67608 dated Mar. 30, 2021.
International Search Report and Written Opinion mailed in PCT/US20/67528 dated Mar. 19, 2021.
International Search Report and Written Opinion mailed in PCT/US20/67146 dated Mar. 29, 2021.
International Search Report and Written Opinion mailed in PCT/US20/67523 dated Mar. 22, 2021.
International Search Report and Written Opinion mailed in PCT/US2020/066543 dated May 11, 2021.

(56) References Cited

OTHER PUBLICATIONS

Morris et al., U.S. Appl. No. 62/526,869; Hydration-Blender Transport and Electric Power Distribution for Fracturing Operation; filed Jun. 28, 2018; USPTO; see entire document.
Final Office Action dated Feb. 4, 2021 in U.S. Appl. No. 16/597,014.
International Search Report and Written Opinion dated Feb. 4, 2021 in PCT/US20/59834.
International Search Report and Written Opinion dated Feb. 2, 2021 in PCT/US20/58906.
International Search Report and Written Opinion dated Feb. 3, 2021 in PCT/US20/58899.
Non-Final Office Action dated Jan. 29, 2021 in U.S. Appl. No. 16/564,185.
Final Office Action dated Jan. 21, 2021 in U.S. Appl. No. 16/458,696.
Final Office Action dated Jan. 11, 2021 in U.S. Appl. No. 16/404,283.
Non-Final Office Action dated Jan. 4, 2021 in U.S. Appl. No. 16/522,043.
International Search Report and Written Opinion dated Dec. 14, 2020 in PCT/US2020/53980.
Non-Final Office Action issued in U.S. Appl. No. 16/871,928 dated Aug. 25, 2021.
Non-Final Office Action issued in U.S. Appl. No. 16/943,727 dated Aug. 3, 2021.
Non-Final Office Action issued in U.S. Appl. No. 14/881,525 dated Jul. 21, 2021.
Non-Final Office Action issued in U.S. Appl. No. 16/404,283 dated Jul. 21, 2021.
Notice of Allowance and Notice of Allowability issued in U.S. Appl. No. 15/829,419 dated Jul. 26, 2021.
Noodbury et al., "Electrical Design Considerations for Drilling Rigs," IEEE Transactions on Industry Applications, vol. 1A-12, No. 4, July/Aug. 1976, pp. 421-431.

* cited by examiner

AUTOMATED FRACTURING SYSTEM AND METHOD

CROSS REFERENCE TO RELATED APPLICATIONS

This application is a continuation of U.S. patent application Ser. No. 16/160,708 filed Oct. 15, 2018, titled "AUTOMATED FRACTURING SYSTEM AND METHOD," now U.S. Pat. No. 10,408,031 issued Sep. 10, 2019, which claims priority to and the benefit of U.S. Provisional Application Ser. No. 62/572,148 filed Oct. 13, 2017 titled "AUTOMATED FRACTURING SYSTEM," the full disclosure of which is hereby incorporated herein by reference in its entirety for all purposes.

BACKGROUND

With advancements in technology over the past few decades, the ability to reach unconventional sources of hydrocarbons has tremendously increased. Horizontal drilling and hydraulic fracturing are two such ways that new developments in technology have led to hydrocarbon production from previously unreachable shale formations. Hydraulic fracturing (fracturing) operations typically require powering numerous components in order to recover oil and gas resources from the ground. For example, hydraulic fracturing usually includes pumps that inject fracturing fluid down the wellbore, blenders that mix proppant into the fluid, cranes, wireline units, and many other components that all must perform different functions to carry out fracturing operations.

Conventionally, these components or systems of components are generally independent systems that are individually controlled by operators. Furthermore, in some cases, operators are also responsible for taking measurements, interpreting raw data, making calculations, and the like. Thus, a large amount of operator intervention to diagnose, interpret, respond to, adjust, and otherwise control operating conditions of the various components.

SUMMARY

Applicant recognized the problems noted above herein and conceived and developed embodiments of systems and methods, according to the present disclosure, for assessing flow rates in hydraulic fracturing systems.

In an embodiment, an automated hydraulic fracturing system includes a pump system fluidly coupled to a wellhead to pump a fracturing fluid into the wellhead, wherein the pump is instrumented with a pump sensor and a pump controller. The hydraulic fracturing system further includes a blender system fluidly coupled to the pump, the blender mixing together one or more materials to form the fracturing fluid, wherein the blender is instrumented with a blender sensor and a blender controller, and a source system for providing at least one of the one or more materials to the blender, wherein the source is instrumented with a source sensor and a source controller. The hydraulic fracturing system also includes another component, the component instrumented with at least one of a component sensor and a component controller. At least one of the pump controller, blender controller, the source controller, or the component controller controls a respective aspect of the automated hydraulic fracturing system based at least in part on automated instructions, the automated instructions generated based on measurements received from at least one of the pump sensor, the blender sensor, the source sensor, or the component sensor.

In an embodiment, an automated hydraulic fracturing system includes a pump system fluidly coupled to a wellhead at a wellsite to pump a fracturing fluid into the wellhead, a blender configured to mix together proppant and a fluid mixture to form the fracturing fluid, a proppant storage and delivery system configured to provide the proppant for the blender, a hydration unit configured to mix an additive into a fluid to form the fluid mixture and provide the fluid mixture to the blender, a fluid storage and delivery system configured to provide the fluid for the hydration unit, an additive storage and delivery system configured to provide the additive to the hydration unit, and an automated control system including a plurality of sensing devices and a plurality of control devices integrated into the pump system, the blender system, the proppant storage and delivery system, the fluid storage and delivery system, and the additive storage and delivery system, the automated control system configured to monitor one or more parameters of the automated hydraulic fracturing system via the plurality of sensing devices and transmit control instructions for one or more of the plurality of control devices to control an aspect of the automated hydraulic fracturing system.

In an embodiment, an automated hydraulic fracturing method includes initiating a hydraulic fracturing operation using an automated hydraulic fracturing system, providing a first material for a fracturing fluid from a first source to a blender, the first source including a source sensor for measuring one or more parameters associated with the first source and a source controller for controlling one or more functions of the first source, providing a second material for the fracturing fluid from a second source to the blender, mixing the first material and the second material at the blender to form the fracturing fluid, the blender including a blender sensor for measuring one or more parameters associated with the blender and a blender controller for controlling one or more functions of the bender, providing the fracturing fluid from the blender to a pump, the pump including a pump sensor for measuring one or more parameters associated with the pump and a pump controller for controlling one or more functions of the pump, injecting the fracturing fluid from the pump into a wellhead coupled to a well, monitoring the one or more parameters via the source sensor, the blender sensor, and the pump sensor, generating automated instructions for at least one of the source controller, the blender controller, or the pump controller based at last in part on the one or more parameters, and controlling at least one of the one or more functions of the first source, the blender, or the pump via the source controller, the blender controller, or the pump controller, respectively, based at least in part on the automated instructions.

BRIEF DESCRIPTION OF DRAWINGS

The foregoing aspects, features, and advantage of embodiments of the present disclosure will further be appreciated when considered with reference to the following description of embodiments and accompanying drawings. In describing embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

DETAILED DESCRIPTION

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. Additionally, recitations of steps of a method should be understood as being capable of being performed in any order unless specifically stated otherwise. Furthermore, the steps may be performed in series or in parallel unless specifically stated otherwise.

Figure 1:
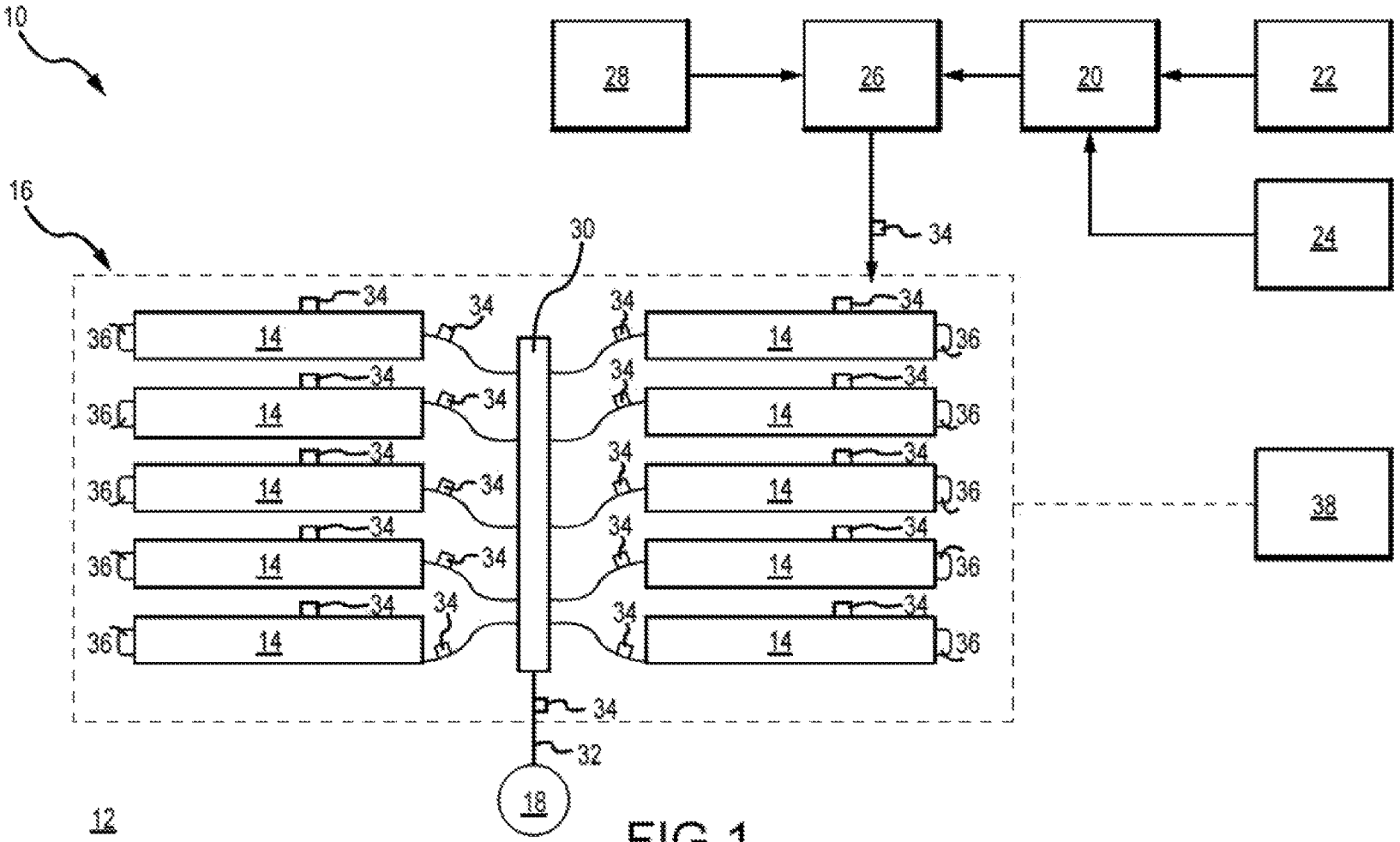
FIG. 1 is a schematic plan view of an embodiment of an automated hydraulic fracturing operation, in accordance with embodiments of the present disclosure.

FIG. 1 is a schematic representation of an embodiment of a hydraulic fracturing system 10 positioned at a well site 12. In the illustrated embodiment, pump trucks 14, which make up a pumping system 16, are used to pressurize a fracturing fluid solution for injection into a wellhead 18. A hydration unit 20 receives fluid from a fluid source 22 via a line, such as a tubular, and also receives additives from an additive source 24. In an embodiment, the fluid is water and the additives are mixed together and transferred to a blender unit 26 where proppant from a proppant source 28 may be added to form the fracturing fluid solution (e.g., fracturing fluid) which is transferred to the pumping system 16. The pump trucks 14 may receive the fracturing fluid solution at a first pressure (e.g., 80 psi to 100 psi) and boost the pressure to around 15,000 psi for injection into the wellhead 18. In certain embodiments, the pump trucks 14 are powered by electric motors.

After being discharged from the pump system 16, a distribution system 30, such as a missile, receives the fracturing fluid solution for injection into the wellhead 18. The distribution system 30 consolidates the fracturing fluid solution from each of the pump trucks 14 (for example, via common manifold for distribution of fluid to the pumps) and includes discharge piping 32 (which may be a series of discharge lines or a single discharge line) coupled to the wellhead 18. In this manner, pressurized solution for hydraulic fracturing may be injected into the wellhead 18. In the illustrated embodiment, one or more sensors 34, 36 are arranged throughout the hydraulic fracturing system 10. In embodiments, the sensors 34 transmit flow data to a data van 38 for collection and analysis, among other things.

Figure 2:
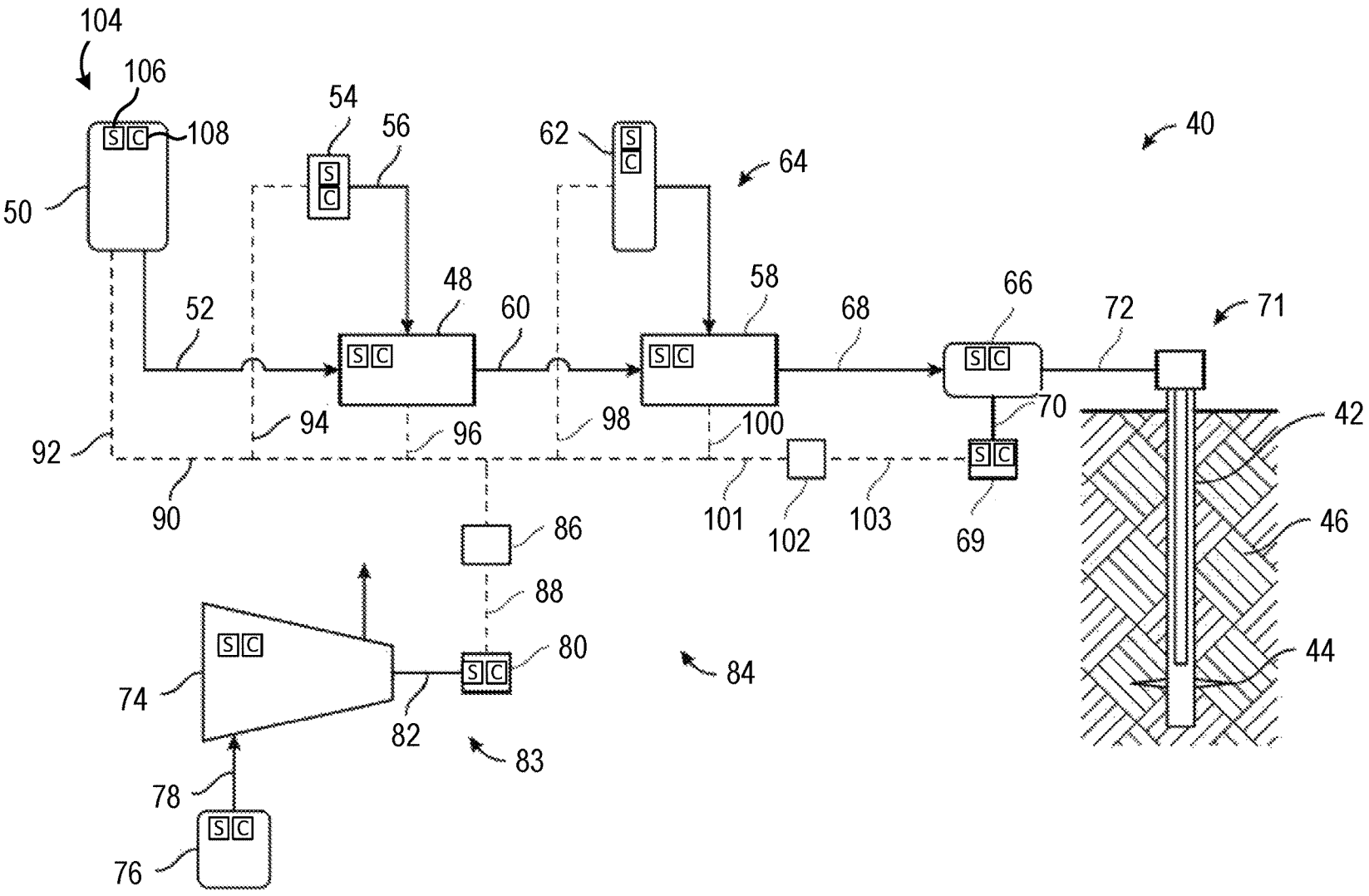
FIG. 2 is a schematic diagram of an embodiment of an automated hydraulic fracturing system, in accordance with embodiments of the present disclosure.

FIG. 2 is a detailed schematic representation of an automated hydraulic fracturing system 40, that can be used for pressurizing a wellbore 42 to create fractures 44 in a subterranean formation 46 that surrounds the wellbore 42. Included with the system 40 is a hydration unit 48 that receives fluid from a fluid source 50 via line 52, and also selectively receives additives from an additive source 54 via line 56. Additive source 54 can be separate from the hydration unit 48 as a stand-alone unit, or can be included as part of the same unit as the hydration unit 48. The fluid, which in one example is water, is mixed inside of the hydration unit 48 with the additives. In an embodiment, the fluid and additives are mixed over a period of time, to allow for uniform distribution of the additives within the fluid. In the example of FIG. 2, the fluid and additive mixture is transferred to a blender unit 58 via line 60. A proppant source 62 contains proppant, which is delivered to the blender unit 58 as represented by line 64, where line 64 can be a conveyer. Inside the blender unit 58, the proppant and fluid/additive mixture are combined to form a fracturing fluid, which is then transferred to a fracturing pump system 66 via line 68; thus fluid in line 68 includes the discharge of blender unit 58 which is the suction (or boost) for the fracturing pump system 66.

Blender unit 58 can have an onboard chemical additive system, such as with chemical pumps and augers. Optionally, additive source 54 can provide chemicals to blender unit 58; or a separate and standalone chemical additive system (not shown) can be provided for delivering chemicals to the blender unit 58. In an example, the pressure of the fracturing fluid in line 68 ranges from around 80 psi to around 100 psi. The pressure of the fracturing fluid can be increased up to around 15,000 psi by pump system 66. A motor 69, which connects to pump system 66 via connection 40, drives pump system 66 so that it can pressurize the fracturing fluid. In one example, the motor 69 is controlled by a variable frequency drive ("VFD").

After being discharged from pump system 66, fracturing fluid is pumped into a wellhead assembly 71. Discharge piping 42 connects discharge of pump system 66 with wellhead assembly 71 and provides a conduit for the fracturing fluid between the pump system 66 and the wellhead assembly 71. In an alternative, hoses or other connections can be used to provide a conduit for the fracturing fluid between the pump system 66 and the wellhead assembly 71. Optionally, any type of fluid can be pressurized by the fracturing pump system 66 to form injection fracturing fluid that is then pumped into the wellbore 42 for fracturing the formation 44, and is not limited to fluids having chemicals or proppant.

An example of a turbine 74 is provided in the example of FIG. 1. The turbine 74 can be gas powered, receiving a combustible fuel from a fuel source 76 via a feed line 78. In one example, the combustible fuel is natural gas, and the fuel source 76 can be a container of natural gas or a well (not shown) proximate the turbine 74. Combustion of the fuel in the turbine 74 in turn powers a generator 80 that produces electricity. Shaft 82 connects generator 80 to turbine 74. The combination of the turbine 74, generator 80, and shaft 82 define a turbine generator 83. In another example, gearing can also be used to connect the turbine 74 and generator 80.

An example of a micro-grid 84 is further illustrated in FIG. 2, and which distributes electricity generated by the turbine generator 83. Included with the micro-grid 84 is a transformer 86 for stepping down voltage of the electricity generated by the generator 80 to a voltage more compatible for use by electrically powered devices in the hydraulic fracturing system 40. In another example, the power generated by the turbine generator and the power utilized by the electrically powered devices in the hydraulic fracturing system 10 are of the same voltage, such as 4160 V, so that main power transformers are not needed. In one embodiment, multiple 3500 kVA dry cast coil transformers are utilized. Electricity generated in generator 80 is conveyed to transformer 86 via line 88. In one example, transformer 86 steps the voltage down from 13.8 kV to around 600 V. Other step down voltages can include 4,160 V, 480 V, or other voltages.

The output or low voltage side of the transformer 56 connects to a power bus 90, lines 92, 94, 96, 98, 100, and 101 connect to power bus 90 and deliver electricity to electrically powered components of the system 40. More specifically, line 92 connects fluid source 20 to bus 90, line 94 connects additive source 24 to bus 90, line 96 connects hydration unit 18 to bus 90, line 98 connects proppant source 62 to bus 90, line 100 connects blender unit 28 to bus 90, and line 101 connects bus 90 to an optional variable frequency drive ("VFD") 102. Line 103 connects VFD 102 to motor 69. In one example, VFD 102 can be used to control operation of motor 69, and thus also operation of pump 66.

In an example, additive source 54 contains ten or more chemical pumps for supplementing the existing chemical pumps on the hydration unit 48 and blender unit 58. Chemicals from the additive source 54 can be delivered via lines 56 to either the hydration unit 48 and/or the blender unit 58. In one embodiment, the elements of the system 40 are mobile and can be readily transported to a wellsite adjacent the wellbore 42, such as on trailers or other platforms equipped with wheels or tracks.

In the illustrated embodiment, one or more instrumentation devices 104 such as various types of sensors 106 and controllers 108 are arranged throughout the hydraulic fracturing system 40 and coupled to one or more of the aforementioned components, including any of the wellhead assembly 71, pump 66, blender unit 58, proppant source 62, hydration unit 48, additive source 54, fluid source 50, generator 80, turbine 74, fuel source 76, any deliveries lines, and various other equipment used in the hydraulic fracturing system 40, not all of which are explicitly described herein for sake of brevity. The instrumentation 104 may include various sensors, actuators, and/or controllers, which may be different for different components. For example, the instrumentation devices 104 may include hardware features such as, low pressure transducer (low and high frequency), high pressure transducers (low and high frequency), low frequency accelerometers, high frequency accelerometers, temperature sensors, external mounted flow meters such as doppler and sonar sensors, magnetic flow meters, turbine flow meters, proximity probes and sensors, speed sensors, tachometers, capacitive, doppler, inductive, optical, radar, ultrasonic, fiber optic, and hall effect sensors, transmitters and receivers, stroke counters, GPS location monitoring, fuel consumption, load cells, PLCs, and timers. In some embodiments, the instrumentation devices may be installed on the components and dispersed in various locations.

The components may also include communication means that enable all the sensor packages, actuation devices, and equipment components to communicate with each other allowing for real time conditional monitoring. This would allow equipment to adjust rates, pressure, operating conditions such as engine, transmission, power ends RPMs, sand storage compartment gates, valves, and actuators, sand delivery belts and shoots, water storage compartments gates, valves, and actuators, water delivery lines and hoses, individual fracture pump's rates as well as collective system rates, blender hydraulics such as chemical pumps, liquid and dry, fan motors for cooling packages, blender discharge pumps, electric and variable frequency powered chemical pumps and auger screws, suction and discharge manifold meters, valves, and actuators. Equipment can prevent failures, reduce continual damage, and control when it is allowed and not allowed to continue to operate based on live and continuous data readings. Each component may be able to provide troubleshooting codes and alerts that more specifically narrow down the potential causes of issues. This allows technicians to more effectively service equipment, or for troubleshooting or other processes to be initialized automatically. Conditional monitoring will identify changes in system components and will be able to direct, divert, and manage all components so that each is performing its job the most efficiently In some embodiments, the sensors may transmit data to a data van 38 for collection and analysis, among other things. In some embodiment, the sensors may transmit data to other components, to the central processing unit, or to devices and control units remote from the site. The communications between components, sensors, and control devices may be wired, wireless, or a combination of both. Communication means may include fiber optics, electrical cables, WiFi, Bluetooth, radio frequency, and other cellular, nearfield, Internet-based, or other networked communication means.

The features of the present disclosure may allow for remote monitoring and control from diverse location, not solely the data van 68. Fracturing control may be integrated in with the sensor and monitoring packages 104 to allow for automated action to be taken when/if needed. Equipment may be able to determine issues or failures on its own, then relay that message with a specified code and alarm. Equipment may also be in control to shut itself down to prevent failures from occurring. Equipment may monitor itself as well as communicate with the system as a whole. This may allow whole system to control equipment and processes so that each and every component is running at its highest efficiency, sand, water, chemical, blenders, pumps, and low and high pressure flow lines. Features of the present disclosure may capture, display, and store data, which may be visible locally and remotely. The data may be accessible live during the data collection and historical data may also be available. Each component to this system can be tested individually with simulation as well as physical function testing.

Operating efficiencies for each individual component and the system 40 may be greatly improved. For example, sand storage and delivery to the blender can be monitored with load cells, sonar sensors and tachometers to determine storage amounts, hopper levels, auger delivery to the tub. Pump efficiencies may be monitored with flow sensors, accelerometers, pressure transducer and tachometers to optimize boost and rate while minimizing harmful conditions such as cavitation or over rating. Failure modes such as wash outs, cutting, valve and/or seat failures, packing issues and supply blockage can be captured and then prevented. Flow lines, both suction supply and discharge can be monitored with flow meters to distribute and optimize flow rates and velocities while preventing over pumping scenarios. Feedback loops of readings from blender to supply manifolds and to pumps can work with each other to optimize pressure and flow. Dropping out of an individual pump may occur preventing further failures, when this occurs the system as a whole may automatically select the best pumps to make up that needed rate. These changes and abilities solve equipment issues and prevent down time as well as provide a means to deliver a consistent job.

In some embodiments, instrumentation devices 104 (any of the above described, among others) can be imbedded, mounted, located in various locations such as in line with flow vessels like hoses, piping, manifolds, placed one pump components such as fluid ends, power ends, transmission, engines, and any component within these individual pieces, mounted external to piping and flow vessels, mounted on under or above sand and water storage containers. Blender hoppers could be duel equipped with hopper proximity level sensors as well as a load cell to determine amount of sand in the hopper at any given time.

Figure 3:
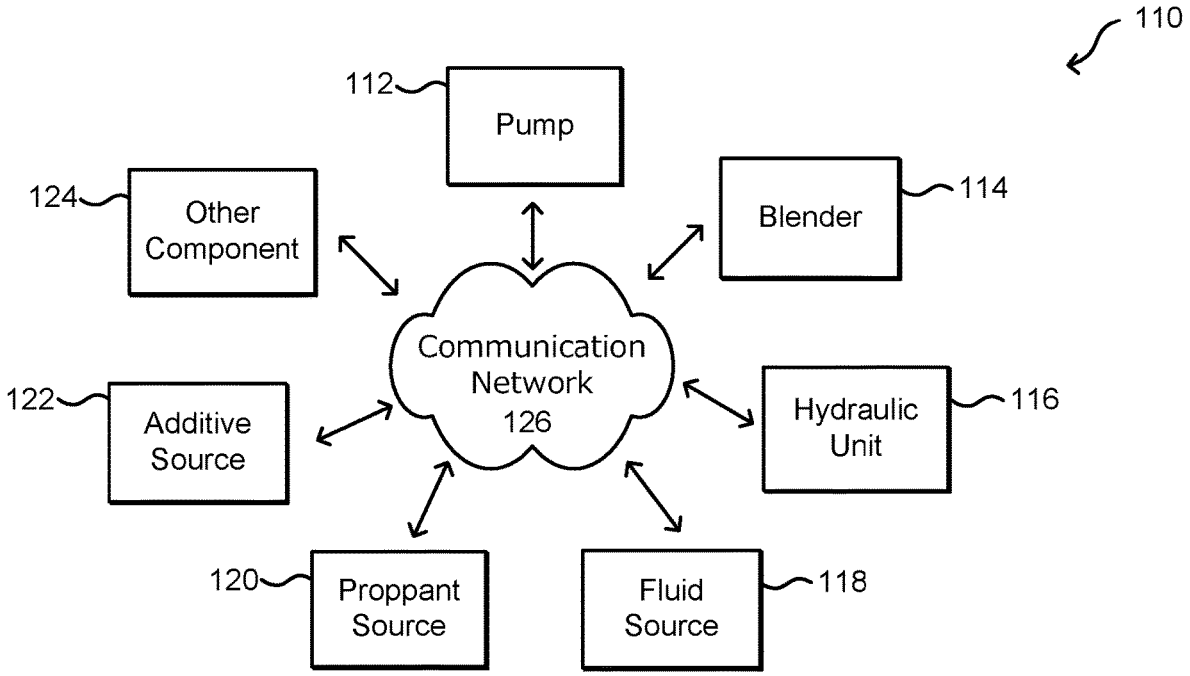
FIG. 3 is a diagram of communicative components of an automated hydraulic fracturing system, in accordance with embodiments of the present disclosure.

FIG. 3 includes a diagram 110 illustrating a connected automated fracturing system, in accordance with various embodiments. In this example, one or more components 42 of a fracturing system, such as a pump 112, blender 114, hydration unit 116, fluid source 118, proppant source 120, additive source 122, and one or more other components 124, may include communication devices for transmitting and receiving data with each other over a communication network 126. In some embodiments, at least some of the components include processors that analyze the data received from one or more of the other components and automatically controls one or more aspects of that component. The communication network 110 may include various types of wired or wireless communication protocols, or a combination of wired and wireless communications. In some embodiments, the connected automated fracturing system further includes one or more of a plurality of components including a manifold, a manifold trailer, a discharge piping, flow lines, conveyance devices, a turbine, a motor, a variable frequency drive, a generator, or a fuel source. Sensors and control devices may be integrated into the one or more of these components, allowing these components to communicate with the rest of the system.

Figure 4:
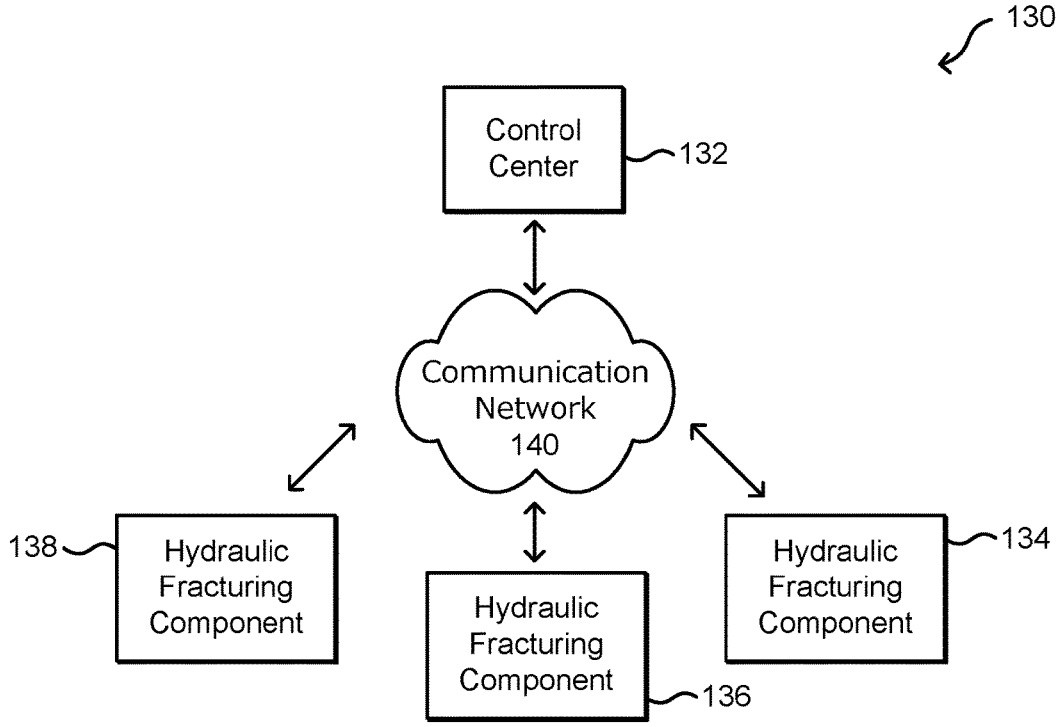
FIG. 4 is a diagram of communicative components of an automated hydraulic fracturing system with a central control center, in accordance with embodiments of the present disclosure.

FIG. 4 includes a diagram 130 illustrating a communications network of the automated fracturing system, in accordance with various embodiments. In this example, one or more hydraulic fracturing components 138, such as, and not limited to, any of those mentioned above, may be communicative with each other via a communication network 140 such as described above with respect to FIG. 3. The components 138 may also be communicative with a control center 132 over the communication network 140. The control center 132 may be instrumented into the hydraulic fracturing system or a component. The control center 132 may be onsite, in a data van, or located remotely. The control center 132 may receive data from any of the components 138, analyze the received data, and generate control instructions for one or more of the components based at least in part on the data. For example, the control center 132 may control an aspect of one component based on a condition of another component. In some embodiments, the control center 140 may also include a user interface, including a display for displaying data and conditions of the hydraulic fracturing system. The user interface may also enable an operator to input control instructions for the components 134. The control center 140 may also transmit data to other locations and generate alerts and notification at the control center 140 or to be received at user device remote from the control center 140.

Figure 5:
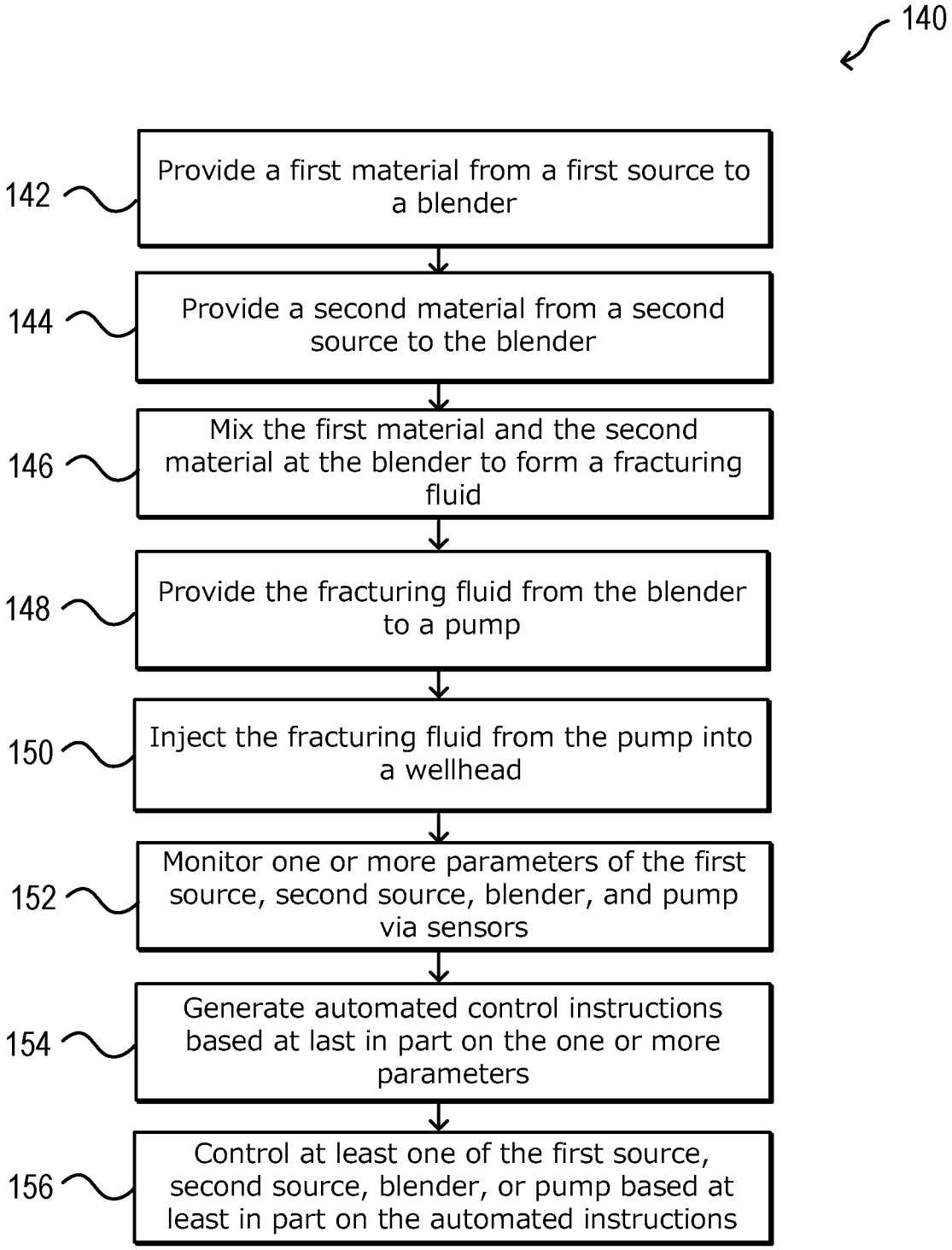
FIG. 5 is a flow chart of an embodiment of an automated hydraulic fracturing method, in accordance with embodiments of the present disclosure.

FIG. 5 is a flow chart of an embodiment of an automated hydraulic fracturing method 140, in accordance with example embodiments. It should be noted that the method may include additional steps, fewer steps, and differently ordered steps than illustrated in this example. In this example, a hydraulic fracturing operation is initiated 142 using an automated hydraulic fracturing system. A first material for a fracturing fluid is provided 144 from a first source to a blender. The first source includes a sensor for measuring one or more parameters associated with the first source and a controller for controlling one or more functions of the first source. A second material for the fracturing fluid is provided from a second source to the blender. The second source may also be instrumented with a sensor and a controller. The first material and the second material is mixed 146 at the blender to form the fracturing fluid. The blender may also be include a sensor for measuring one or more parameters associated with the blender and a controller for controlling one or more functions of the bender. The fracturing fluid is provided from the blender to a pump, and the pump includes a sensor for measuring one or more parameters associated with the pump and a controller for controlling one or more functions of the pump. The fracturing fluid is then injected 150 from the pump into a wellhead coupled to a well. The one or more parameters are monitored 152 via the sensors on the first source, second source, blender, pump, and various other sensors in the hydraulic fracturing system. Automated instructions can then be generated 154 for at least one of the source controller, the blender controller, or the pump controller based at last in part on the one or more parameters.

At least one of the one or more functions of the first source, the blender, the pump, or other component of the hydraulic fracturing system may be controlled 156 via the respective controller based on the automated control instructions. In some embodiments, the instructions may cause one or more of the control devices to automatically adjust one or more of a flow rate, a pressure, power, motor speed, gates, valve, actuators, delivery lines and conveyance devices, pump rates, or cooling systems. For example, a pump system may include comprises a motor controlled by the pump controller based at least in part on the automated instructions. In some embodiments, the blender includes at least one of a chemical pump, a cooling system, an auger, a blender discharge pump, a valve, or an actuator, any of which may be controlled by the blender controller based at least in part on the automated instructions. In some embodiments, the first or second source may include at least one of a gate, a valve, an actuator, a delivery belt, a delivery line, or a chemical pump, any one of which may controlled by a source controller based at least in part on the automated instructions. For example, the rate of delivery of a material may be automatically started, stopped, or adjusted based on the automated instructions. The pressure or rate at which the fracturing fluid is injected into the wellhead may be controlled based on the automated instructions.

The hydraulic fracturing system may include other components, such as a turbine, a generator, a hydration unit, a distribution system, a fuel source, or a wellhead, among others. These components may also be instrumented with sensors that measures at least one parameter associated with the turbine, the generator, the hydration unit, the distribution system, the fuel source, or the wellhead. These components may also include controllers, which control at least one aspect of the turbine, the generator, the hydration unit, the distribution system, the fuel source, or the wellhead, based at least in part on the automated instructions. In some embodiments, the hydraulic fracturing system includes a plurality of pumps and a distribution system, in which fracturing fluid is provided from the blender to the plurality of pumps, the fracturing fluid is provided from the plurality of pumps to the distribution system, and the fracturing fluid is injected from the distribution system into the wellbore. The individual pressure at each pump may be automatically adjusted based on the automated instructions. The combined or overall pump rate of the plurality of pumps may also be controlled, and the rate at the distribution system may also be controlled via the automated instructions.

In some embodiments, the method 140 may include detecting that at least one of the one or more parameters is outside of an acceptable threshold and automatically stopping or adjusting one or more functions of the hydraulic fracturing system in response to the detection. In some embodiments, the method 140 may include detecting substandard performance in one or more areas of the automated hydraulic fracturing system, automatically troubleshooting the automated hydraulic fracturing system based on live data from a plurality of sensors or previous data collected by the sensors, determining one or more causes or suspected causes of the substandard performance, and automatically adjusting one or more components of the automated hydraulic fracturing system to resolve the substandard performance. In some embodiments, the system may provide troubleshooting codes or alerts indicative of one or more sources of a performance issue.

Figure 6:
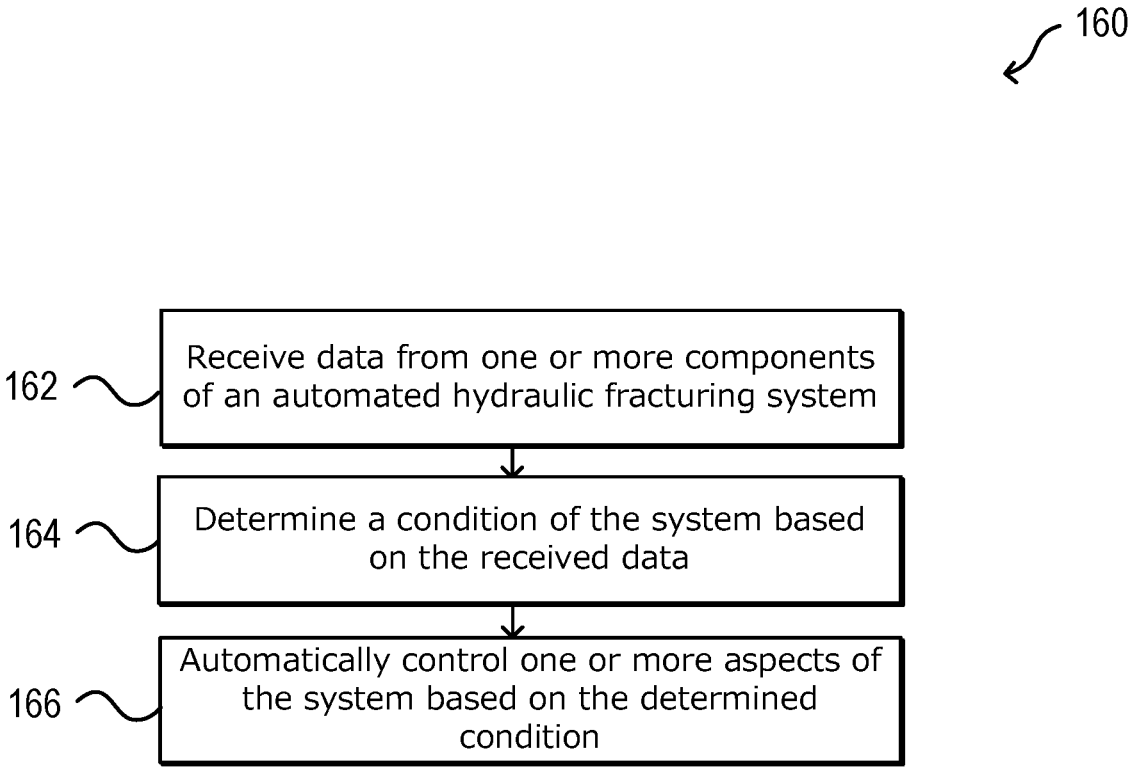
FIG. 6 is a flow chart of an embodiment of a method of controlling an automated hydraulic fracturing system, in accordance with embodiments of the present disclosure.

FIG. 6 illustrates a method 160 of controlling an automated fracturing system, in accordance with various embodiments. In this embodiment, the method 160 includes receiving 162 data from one or more components of an automated fracturing system, such as those described above. The method 160 further includes determining 164 a condition of the system based on the received data. The method further includes controlling 166 one or more aspects of the system based on the determined condition.

Figure 7:
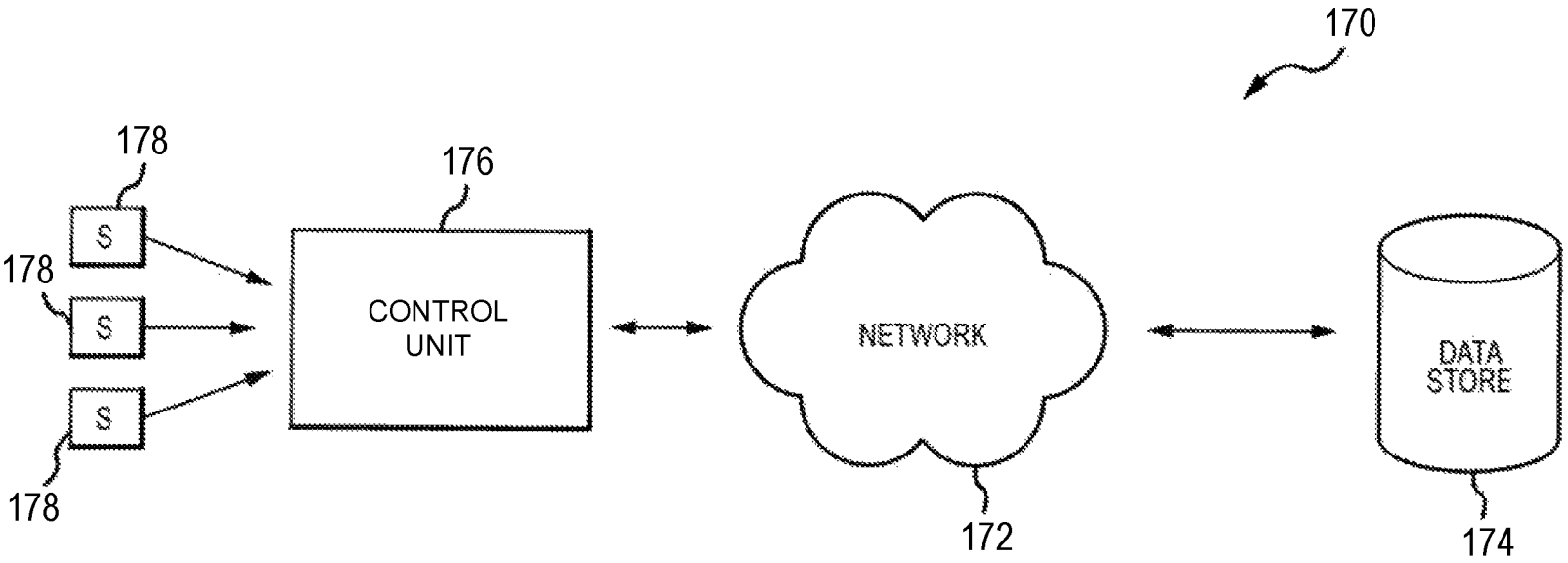
FIG. 7 is a block diagram of an embodiment of a control system of an automated hydraulic fracturing system, in accordance with embodiments of the present disclosure.

FIG. 7 is a block diagram of an embodiment of a control system 170 for receiving, analyzing, and storing information from the well site. As described above, sensors 178 are arranged at the well site and may transmit data to a control unit 176 for evaluation and potential adjustments to operating parameters of equipment at the well site. The control unit 176 may be communicatively coupled to a network 172, such as the Internet, that can access a data store 174, such as a cloud storage server. Accordingly, in embodiments, data from the sensors 178 is transmitted to the control unit 176 (which may be located on a component, within a data van, or remotely) and is stored locally. However, the control unit 176 may upload the data from the sensors 178 along with other data, to the data store 174 via the network 172. Accordingly, data from previous pumping operations or different sensors may be utilized to adjust various aspects of the hydraulic fracturing operation as needed. For example, the flow data from the sensor 178 may be coupled with information from the sensors 178 (such as the vibration sensor, gear sensors, RPM sensors, pressure sensors, etc.) to provide diagnostics with information from the data store 174. For example, previous data may be used as training data for a machine learning model for predicting various control parameters of a present operation. In embodiments, the data store 174 includes information of the equipment used at the well site. It should be appreciated that, in various embodiments, information from the data store 174 may be stored in local storage, for example in storage within a data can, and as a result, communication over the network 172 to the remote data store 174 may not be used. For example, in various embodiments, drilling operations may be conducted at remote locations where Internet data transmission may be slow or unreliable. As a result, information from the data store 174 may be downloaded and stored locally at the data van before the operation, thereby providing access to the information for evaluation of operation conditions at the well site.

The foregoing disclosure and description of the disclosed embodiments is illustrative and explanatory of the embodiments of the invention. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. An automated hydraulic fracturing system, comprising:

a pump system fluidly coupled to a wellhead at a wellsite to pump a fracturing fluid into the wellhead;

a blender configured to mix together proppant and a fluid mixture to form the fracturing fluid;

a proppant storage and delivery system configured to provide the proppant for the blender;

a hydration unit configured to mix an additive into a fluid to form the fluid mixture and provide the fluid mixture to the blender;

a fluid storage and delivery system configured to provide the fluid for the hydration unit;

an additive storage and delivery system configured to provide the additive to the hydration unit; and a plurality of sensing devices and a plurality of control devices integrated into the pump system, the blender system, the proppant storage and delivery system, the fluid storage and delivery system, and the additive storage and delivery system, the plurality of sensing devices configured to monitor one or more parameters of the pump system, the blender system, the proppant storage and delivery system, the fluid storage and delivery system, and the additive storage and delivery system, and the plurality of control devices configured to control one or more functions of the pump system, the blender system, the proppant storage and delivery system, the fluid storage and delivery system, and the additive storage and delivery system according to automated instructions generated based on the one or more parameters.

2. The system of claim 1, further comprising one or more of a plurality of components including a manifold, a manifold trailer, a discharge piping, flow lines, conveyance devices, a turbine, a motor, a variable frequency drive, a generator, or a fuel source, wherein the automated control system comprises sensors and control devices integrated into the one or more of the plurality of components.

3. The system of claim 1, wherein the control instructions cause the one or more of the plurality of control devices to automatically adjust one or more of a flow rate, a pressure, power, motor speed, gates, valve, actuators, delivery lines and conveyance devices, pump rates, or cooling systems.

4. The system of claim 1, wherein the automated control system comprises processing devices located at the wellsite, remote from the wellsite, or both.

5. The system of claim 1, further comprising a central processing system configured to receive the one or more parameters from the plurality of sensing devices, and generate the automated instructions based on the one or more parameters.

6. An automated hydraulic fracturing system, comprising:

a pump system fluidly coupled to a wellhead to pump a fracturing fluid into the wellhead, wherein the pump is instrumented with a pump sensor and a pump controller;

a blender system fluidly coupled to the pump, the blender mixing together one or more materials to form the fracturing fluid, wherein the blender is instrumented with a blender sensor and a blender controller;

a proppant storage and delivery system configured to provide proppant for the blender, wherein the proppant storage and delivery system is instrumented with a proppant sensor and proppant controller;

a hydration unit configured to mix an additive into a fluid to form the fluid mixture and provide the fluid mixture to the blender, wherein the hydration unit is instrumented with a hydration sensor and hydration controller;

a fluid storage and delivery system configured to provide the fluid for the hydration unit, wherein the fluid storage and delivery system is instrumented with a fluid sensor and fluid controller;

an additive storage and delivery system configured to provide the additive to the hydration unit, wherein the additive storage and delivery system is instrumented with an additive sensor and additive controller; and an automated control system comprising the pump sensor and controller, the blender sensor and controller, the proppant sensor and controller, the hydration sensor and controller, the fluid sensor and controller, and the additive sensor and controller, the automated control system configured to monitor one or more parameters of the automated hydraulic fracturing system via one or more of the sensors and transmit control instructions for one or more of the controllers to control one or more aspects of the automated hydraulic fracturing system.

7. The system of claim 6, wherein the pump system comprises a motor controlled by the pump controller based at least in part on the automated instructions.

8. The system of claim 6, wherein the blender comprises at least one of a chemical pump, a cooling system, an auger, a blender discharge pump, a valve, or an actuator, the at least one controlled by the blender controller based at least in part on the automated instructions.

9. The system of claim 6, further comprising:

a component, the component instrumented with at least one of a component sensor and a component controller.

10. The system of claim 9, wherein the component comprises at least one of a turbine, a generator, a distribution system, a fuel source, or a wellhead.

11. The system of claim 10, wherein the component sensor measures at least one parameter associated with the turbine, the generator, the distribution system, the fuel source, or the wellhead, and the component controller controls at least one aspect of the turbine, the generator, the distribution system, the fuel source, or the wellhead, based at least in part on the automated instructions.

12. The system of claim 6, further comprising a central processing system configured to receive the measurements from the pump sensor, the blender sensor, the proppant sensor, the hydration sensor, the fluid sensor, and the additive sensor, and generate the automated instructions based on the measurements.

13. The system of claim 12, wherein the central processing system is configured to generate alerts or notifications based on the measurements, the alerts or notifications indicating a condition of a certain component or operation.

14. An automated hydraulic fracturing system, comprising:

a pump system fluidly coupled to a wellhead at a wellsite to pump a fracturing fluid into the wellhead, the pump system comprising a first sensing device configured to measure one or more parameters of the pump system and a first control device configured to control one or more aspects of the pump system based on automated instructions received at the first control device;

a blender configured to mix together proppant and a fluid mixture to form the fracturing fluid, the blender comprising a second sensing device configured to measure one or more parameters of the blender and a second control device configured to control one or more aspects of the blender based on automated instructions received at the second control device;

a proppant storage and delivery system configured to provide the proppant for the blender, the proppant storage and delivery system comprising a third sensing device configured to measure one or more parameters of the proppant storage and delivery system and a third control device configured to control one or more aspects of the proppant storage and delivery system based on automated instructions received at the third control device;

a hydration unit configured to mix an additive into a fluid to form the fluid mixture and provide the fluid mixture to the blender, the hydration unit comprising a fourth sensing device configured to measure one or more parameters of the hydration unit and a fourth control device configured to control one or more aspects of the hydration unit based on automated instructions received at the fourth control device;

a fluid storage and delivery system configured to provide the fluid for the hydration unit, the fluid storage and delivery system comprising a fifth sensing device configured to measure one or more parameters of the fluid storage and delivery system and a fifth control device configured to control one or more aspects of the fluid storage and delivery system based on automated instructions received at the fifth control device; and an additive storage and delivery system configured to provide the additive to the hydration unit, the additive storage and delivery system comprising a sixth sensing device configured to measure one or more parameters of the additive storage and delivery system and a sixth control device configured to control one or more aspects of the additive storage and delivery system based on automated instructions received at the sixth control device.

15. The system of claim 14, wherein the automated instructions received at the first control device are generated based on the one or more parameters measured by the first sensor, second sensor, third sensor, fourth sensor, fifth sensor, or sixth sensor.

16. The system of claim 14, further comprising a central processing system configured to receive the one or more parameters measured by the first sensor, second sensor, third sensor, fourth sensor, fifth sensor, or sixth sensor, and generate the automated instructions received at the first control device, second control device, third control device, fourth control device, fifth control device, or sixth control device.

17. The system of claim 14, wherein the pump system comprises a motor controlled by the first control device based at least in part on the automated instructions received at the first control device.

18. The system of claim 14, wherein the blender comprises at least one of a chemical pump, a cooling system, an auger, a blender discharge pump, a valve, or an actuator, the at least one controlled by the second control device based at least in part on the automated instructions received at the second control device.

19. The system of claim 14, further comprising further comprising one or more of a plurality of components including a manifold, a manifold trailer, a discharge piping, flow lines, conveyance devices, a turbine, a motor, a variable frequency drive, a generator, or a fuel source, and a plurality of additional sensors and control devices integrated into the one or more of the plurality of components.

20. The system of claim 14, wherein the automated instructions cause the one or more of first, second, third, fourth, fifth, or sixth control devices to automatically adjust one or more of a flow rate, a pressure, power, motor speed, gates, valve, actuators, delivery lines and conveyance devices, pump rates, or cooling systems.

* * * * *